US010421279B2

(12) United States Patent
Chen et al.

(10) Patent No.: US 10,421,279 B2
(45) **Date of Patent: *Sep. 24, 2019**

(54) MOLDED PRINTHEAD

(71) Applicant: HEWLETT-PACKARD DEVELOPMENT COMPANY, L.P., Houston, TX (US)

(72) Inventors: Chien-Hua Chen, Corvallis, OR (US); Michael W. Cumbie, Albany, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/798,108

(22) Filed: Oct. 30, 2017

(65) Prior Publication Data

US 2018/0065374 A1 Mar. 8, 2018

Related U.S. Application Data

(63) Continuation of application No. 15/234,223, filed on Aug. 11, 2016, now Pat. No. 9,844,946, which is a (Continued)

(30) Foreign Application Priority Data

Feb. 28, 2013 (WO) ..... PCT/US2013/028216
Jun. 17, 2013 (WO) ..... PCT/US2013/046065

(51) Int. Cl.
*B41J 2/14* (2006.01)
*B41J 2/16* (2006.01)
(Continued)

(52) U.S. Cl.
CPC ..... *B41J 2/1637* (2013.01); *B41J 2/14* (2013.01); *B41J 2/1433* (2013.01); (Continued)

(58) Field of Classification Search
CPC .. B41J 2/14072; B41J 2/14145; B41J 2/1433; B41J 2/155; B41J 2/1601; B41J 2/1603; (Continued)

(56) References Cited

U.S. PATENT DOCUMENTS 4,633,274 A 12/1986 Matsuda
4,873,622 A 10/1989 Komuro
(Continued)

FOREIGN PATENT DOCUMENTS

CN 101124519 2/2008
CN 102470672 A 5/2012
(Continued)

OTHER PUBLICATIONS

Cheng, et al; "A Monolithic Thermal Inkjet Printhead Combining Anisotropic Etching and Electro Plating"; Jul. 2000; https://www.google.co.in/url?sa=t&rct=j&q=&esrc=s&source=web&cd=3&cad=rja&ved=0CDcQFjAC&url=http%3A%2F%2Fwww.dtic.mil%2Fcgi-bin%2FGetTRDoc%3FAD%3DADP011361&ei=yJtnUquoH8nDrAeY9YCgDw&usg=AFQjCNF-gBV3GucuQ5XgSSW26Kzwm-5Vbg&sig2=rNEz53dBx5nfTedxh9HLYg&bvm=bv.55123115,d.bmk.

*Primary Examiner* — Anh T Vo
(74) *Attorney, Agent, or Firm* — HP Inc. Patent Department

(57) ABSTRACT

In one example, a molded printhead includes a printhead die in a molding having a channel therein through which fluid may pass directly to a back part of the die. The front part of the die is exposed outside the molding surrounding the die. Electrical connections are made between terminals at the front part of the die and contacts to connect to circuitry external to the printhead.

19 Claims, 19 Drawing Sheets

Related U.S. Application Data continuation of application No. 14/770,945, filed as application No. PCT/US2013/068529 on Nov. 5, 2013, now Pat. No. 9,446,587.

(51) Int. Cl.
*B41J 2/155* (2006.01)
*B41J 2/175* (2006.01)

(52) U.S. Cl.
CPC ..... *B41J 2/14072* (2013.01); *B41J 2/14145* (2013.01); *B41J 2/155* (2013.01); *B41J 2/16* (2013.01); *B41J 2/1601* (2013.01); *B41J 2/1603* (2013.01); *B41J 2/1607* (2013.01); *B41J 2/1628* (2013.01); *B41J 2/17526* (2013.01); *B41J 2/17553* (2013.01); *B41J 2002/14362* (2013.01); *B41J 2002/14419* (2013.01); *B41J 2002/14491* (2013.01); *B41J 2202/19* (2013.01); *B41J 2202/20* (2013.01)

(58) Field of Classification Search
CPC ..... B41J 2/1607; B41J 2/1628; B41J 2/1637; B41J 2/17526; B41J 2/17553; B41J 2002/14362; B41J 2002/14419; B41J 2202/20
See application file for complete search history.

(56) References Cited

U.S. PATENT DOCUMENTS

| | | | | |
|---|---|---|---|---|
| 5,016,023 | A | 5/1991 | Chan | |
| 5,160,945 | A | 11/1992 | Drake | |
| 5,696,544 | A | 12/1997 | Komuro | |
| 5,719,605 | A | 2/1998 | Anderson | |
| 6,188,414 | B1 | 2/2001 | Wong | |
| 6,250,738 | B1 | 6/2001 | Waller | |
| 6,341,845 | B1 | 1/2002 | Scheffelin | |
| 6,554,399 | B2 | 4/2003 | Wong | |
| 6,869,166 | B2 | 3/2005 | Brugue | |
| 7,240,991 | B2 * | 7/2007 | Timm | B41J 2/14024 347/40 |
| 7,490,924 | B2 | 2/2009 | Haluzak | |
| 7,547,094 | B2 | 6/2009 | Kawamura | |
| 7,658,470 | B1 | 2/2010 | Jones | |
| 7,828,417 | B2 | 11/2010 | Haluzak | |
| 8,246,141 | B2 | 8/2012 | Petruchik | |
| 8,454,130 | B2 | 6/2013 | Iinuma | |
| 8,496,317 | B2 | 7/2013 | Ciminelli | |
| 9,446,587 | B2 * | 9/2016 | Chen | B41J 2/14072 |
| 9,844,946 | B2 * | 12/2017 | Chen | B41J 2/14072 |
| 2004/0032468 | A1 | 2/2004 | Killmeier | |
| 2005/0024444 | A1 | 2/2005 | Conta | |
| 2005/0046663 | A1 | 3/2005 | Silverbrook | |
| 2008/0259125 | A1 * | 10/2008 | Haluzak | B41J 2/16 347/50 |
| 2009/0225131 | A1 | 9/2009 | Chen | |
| 2010/0271445 | A1 | 10/2010 | Sharan | |
| 2011/0020964 | A1 | 1/2011 | McAvoy | |
| 2011/0037808 | A1 | 2/2011 | Ciminelli | |
| 2011/0292126 | A1 | 12/2011 | Nystrom | |
| 2011/0298868 | A1 | 12/2011 | Fielder | |
| 2012/0019593 | A1 | 1/2012 | Scheffelin | |
| 2013/0320471 | A1 * | 12/2013 | Luan | H01L 27/14618 257/432 |

FOREIGN PATENT DOCUMENTS

| | | | |
|---|---|---|---|
| CN | 102971151 | A | 3/2013 |
| EP | 0822078 | A2 | 2/1998 |
| EP | 0822078 | A3 | 6/1999 |
| EP | 1095773 | | 5/2001 |
| JP | 2006321222 | | 11/2006 |
| JP | 2008-511130 | | 4/2008 |
| JP | 2013-501655 | | 1/2013 |
| TW | I295632 | | 4/2008 |
| WO | WO-2006066306 | | 6/2006 |
| WO | WO-2011019529 | A1 | 2/2011 |
| WO | WO-2012134480 | | 10/2012 |
| WO | WO-2013016048 | | 1/2013 |

* cited by examiner

MOLDED PRINTHEAD

BACKGROUND

Conventional inkjet printheads require fluidic fan-out from microscopic ink ejection chambers to macroscopic ink supply channels.

DRAWINGS

The same part numbers designate the same or similar parts throughout the figures. The figures are not necessarily to scale. The relative size of some parts is exaggerated to more clearly illustrate the example shown.

DESCRIPTION

Conventional inkjet printheads require fluidic fan-out from microscopic ink ejection chambers to macroscopic ink supply channels. Hewlett-Packard Company has developed new, molded inkjet printheads that break the connection between the size of the die needed for the ejection chambers and the spacing needed for fluidic fan-out, enabling the use of tiny printhead die "slivers" such as those described in international patent application numbers PCT/US2013/046065, filed Jun. 17, 2013 titled Printhead Die, and PCT/US2013/028216, filed Feb. 28, 2013 title Molded Print Bar, each of which is incorporated herein by reference in its entirety. The inexpensive molding that holds the printhead die slivers can also be used as the structural underpinning for interconnect wiring, to support wire bonds, and to enable the use of tape automated bonding (TAB) for connecting to external circuitry.

Accordingly, in one example of a new molded printhead, printhead die slivers are molded into a molding having a channel therein through which fluid may pass directly to a back part of each die sliver. The front part of each die sliver is exposed outside the molding and co-planar with a surface of the molding surrounding the die sliver. Electrical connections are made between the front part of each die sliver and external contacts with conductors formed along the surface of the molding, conductors in a printed circuit board molded into the molding, and/or conductors in a tape automated bond (TAB) circuit affixed to the molding. This and other examples of a molded printhead may be implemented in scanning type printing fluid cartridges and in page wide print bars. However, examples of the new molded printhead are not limited to printing fluid cartridges or page wide print bars, but may be implemented in other structures or assemblies and for other applications. The examples shown in the Figures and described herein, therefore, illustrate but do not limit the invention, which is defined in the Claims following this Description.

As used in this document, a "printhead" and a "printhead die" mean that part of an inkjet printer or other inkjet type dispenser that can dispense fluid from one or more openings. A printhead includes one or more printhead dies. A die "sliver" means a printhead die with a ratio of length to width of 50 or more. "Printhead" and "printhead die" are not limited to printing with ink and other printing fluids but also include inkjet type dispensing of other fluids and/or for uses other than printing.

Figure 1:
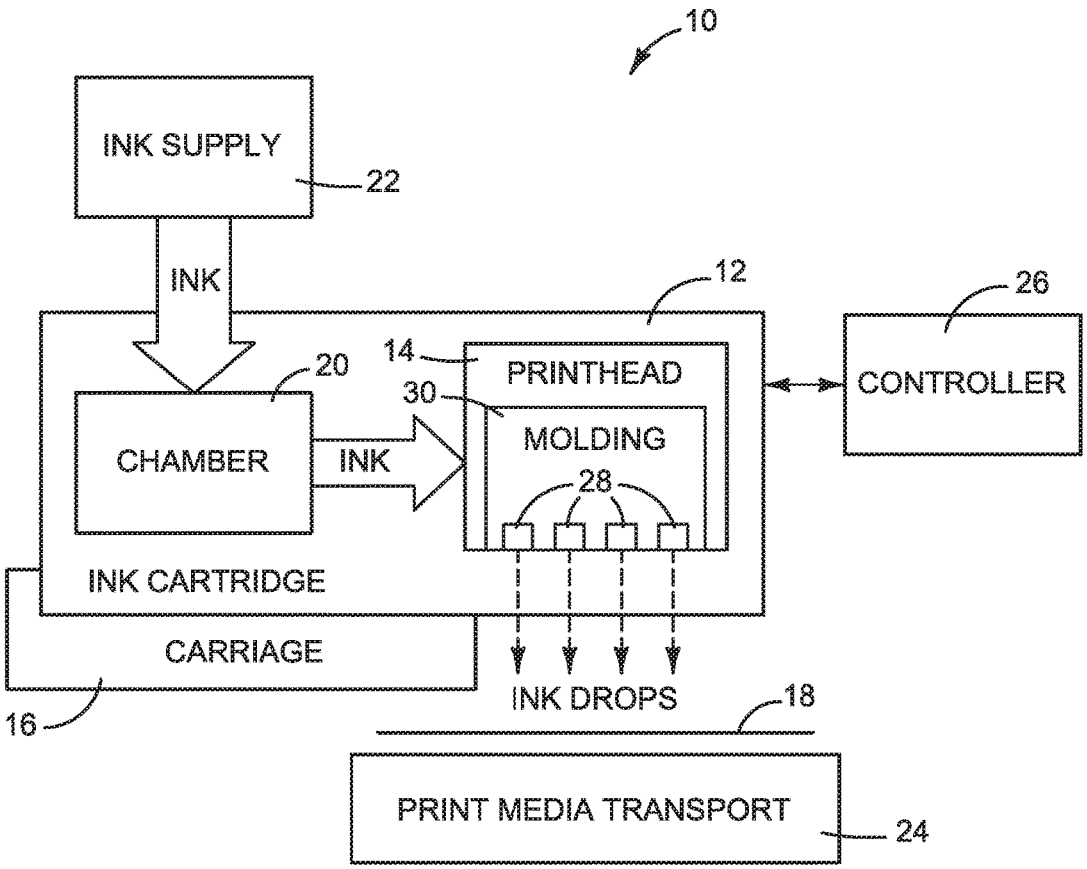
FIG. 1 is a block diagram illustrating an inkjet printer with an ink cartridge implementing one example of a new molded printhead.
Figure 2:
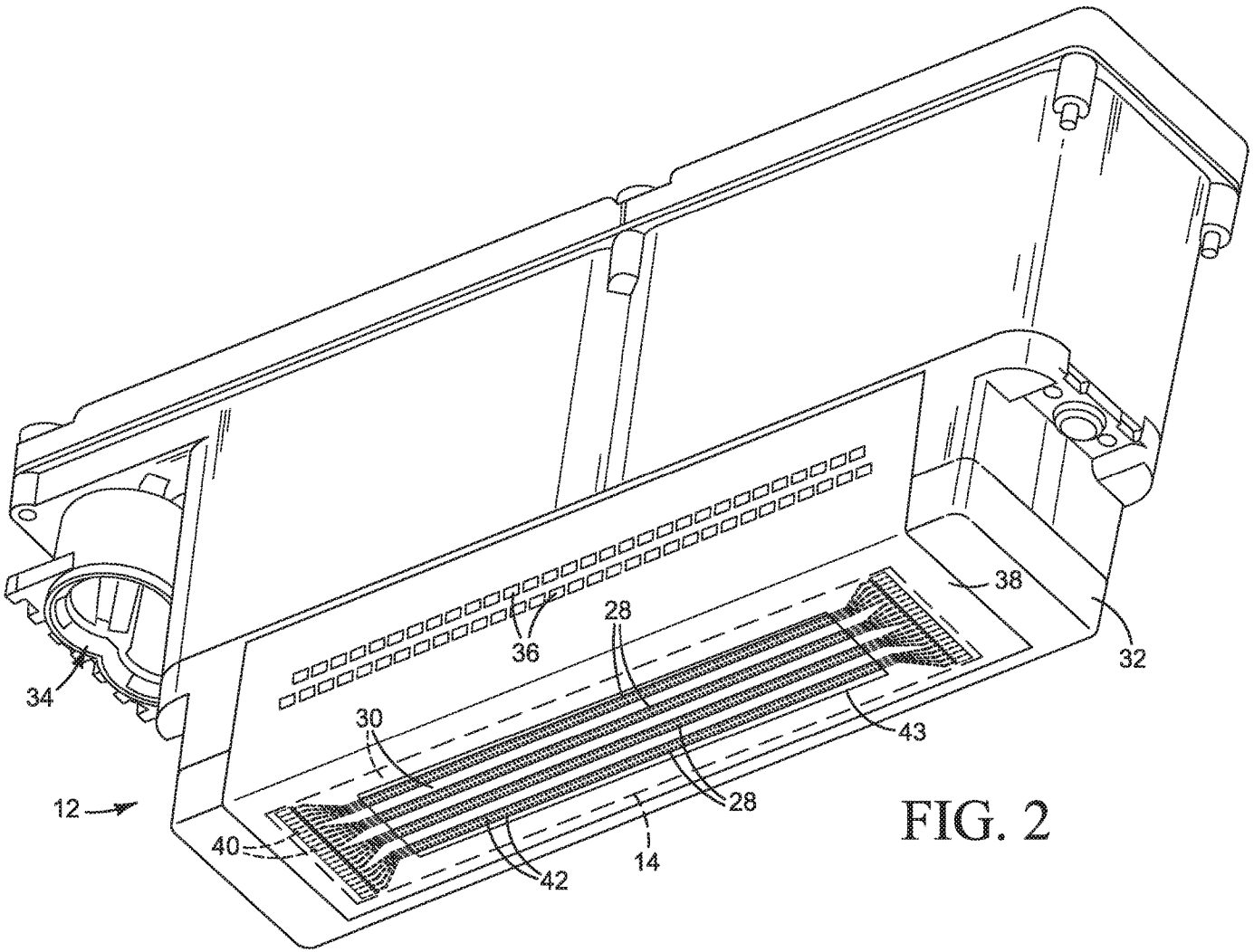
FIG. 2 is a perspective view illustrating one example of an ink cartridge such as might be used in the printer shown in FIG. 1.

FIG. 1 is a block diagram illustrating an inkjet printer 10 with an ink cartridge 12 implementing one example of a molded printhead 14. FIG. 2 is a perspective view illustrating one example of an ink cartridge 12 such as might be used in the printer 10 shown in FIG. 1. Referring first to FIG. 1, printer 10 includes an ink cartridge 12 carried by a carriage 16 that may be scanned back and forth over a print media 18 to apply ink to media 18 in the desired pattern. In the example shown, cartridge 12 also includes an ink chamber 20 housed together with printhead 14 to receive ink from an external supply 22. In other examples, the ink supply may be integrated into chamber 20 as part of a self-contained ink cartridge 12. An ink cartridge 12 is also commonly referred to as a printer cartridge or an ink pen. Printer 10 includes a print media transport 24 to move a web or sheet media 18 past ink cartridge 12. A printer controller 26 represents the programming, processor(s) and associated memory(ies), and the electronic circuitry and components needed to control the operative elements of printer 10.

Referring now also to FIG. 2, ink cartridge 12 includes a printhead 14 with four printhead dies 28 embedded in a molding 30 that is supported by a cartridge housing 32. While a single printhead 14 with four dies 28 is shown for ink cartridge 12, other configurations are possible, for example with more printheads 14 each with more or fewer dies 28. Cartridge 12 is fluidically connected to ink supply 22 through an ink port 34 and electrically connected to controller 26 through electrical contacts 36. Contacts 36 are formed in a so-called "flex circuit" 38 affixed to housing 32. Tiny wires (not shown) embedded in flex circuit 38, often referred to as traces or signal traces, connect contacts 36 to corresponding contacts 40 on printhead 14. Ink ejection orifices 42 on each printhead die 28 are exposed through an opening 43 in flex circuit 38 along the bottom of cartridge housing 32.

Figure 3:
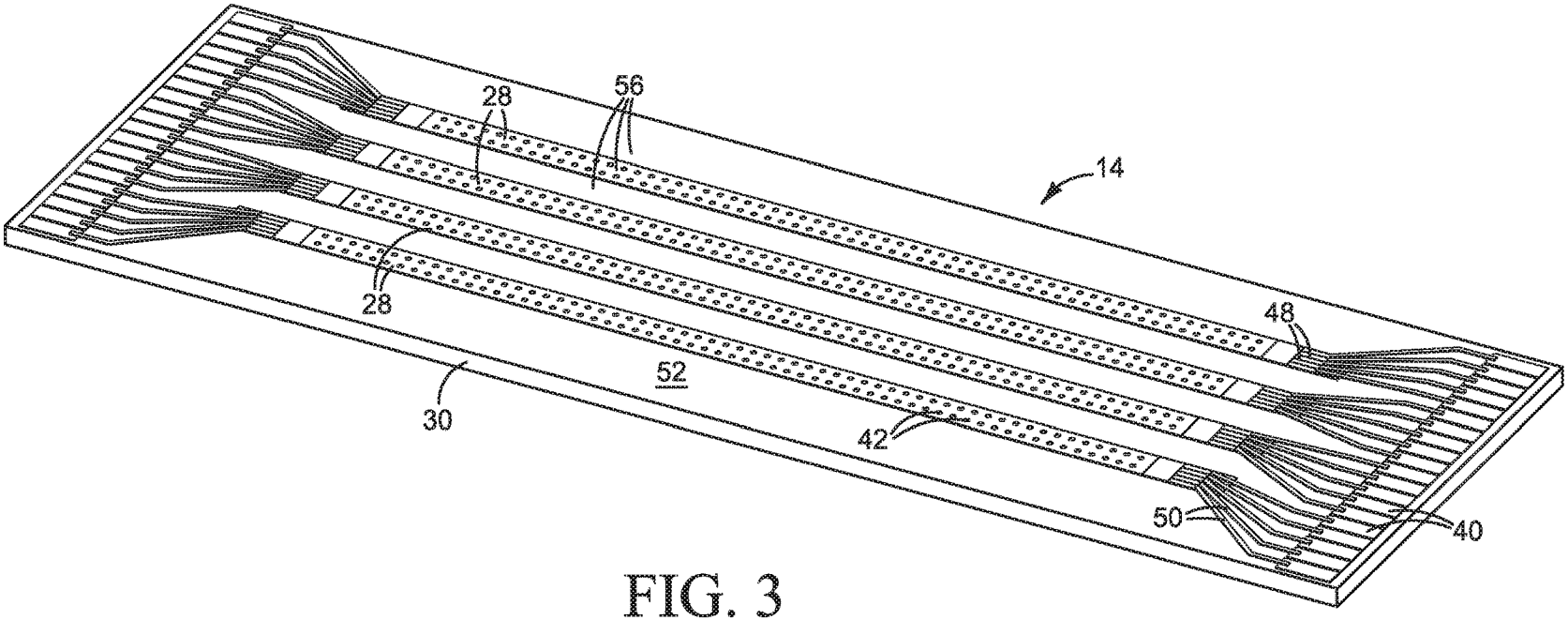
FIGS. 3 and 4 are perspective front and back views, respectively, of one example of a molded printhead such as might be used in the ink cartridge shown in FIG. 2.
Figure 4:
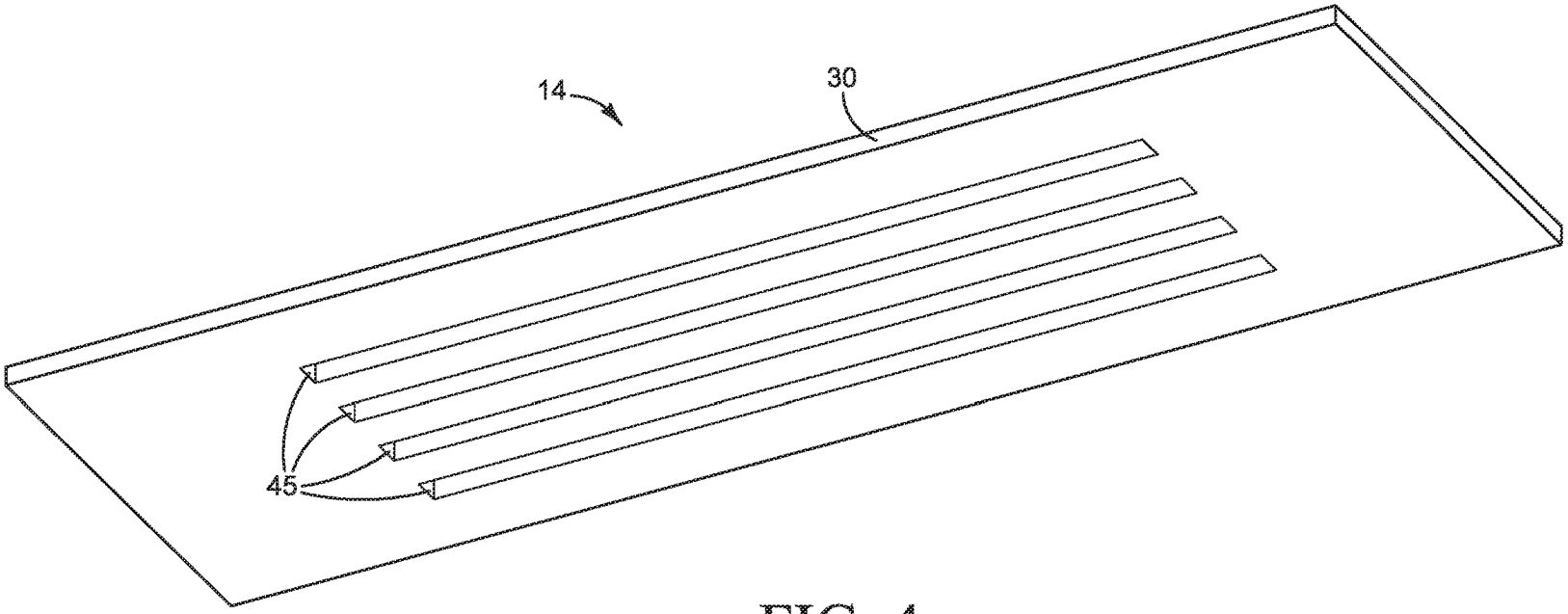
Figure 5:
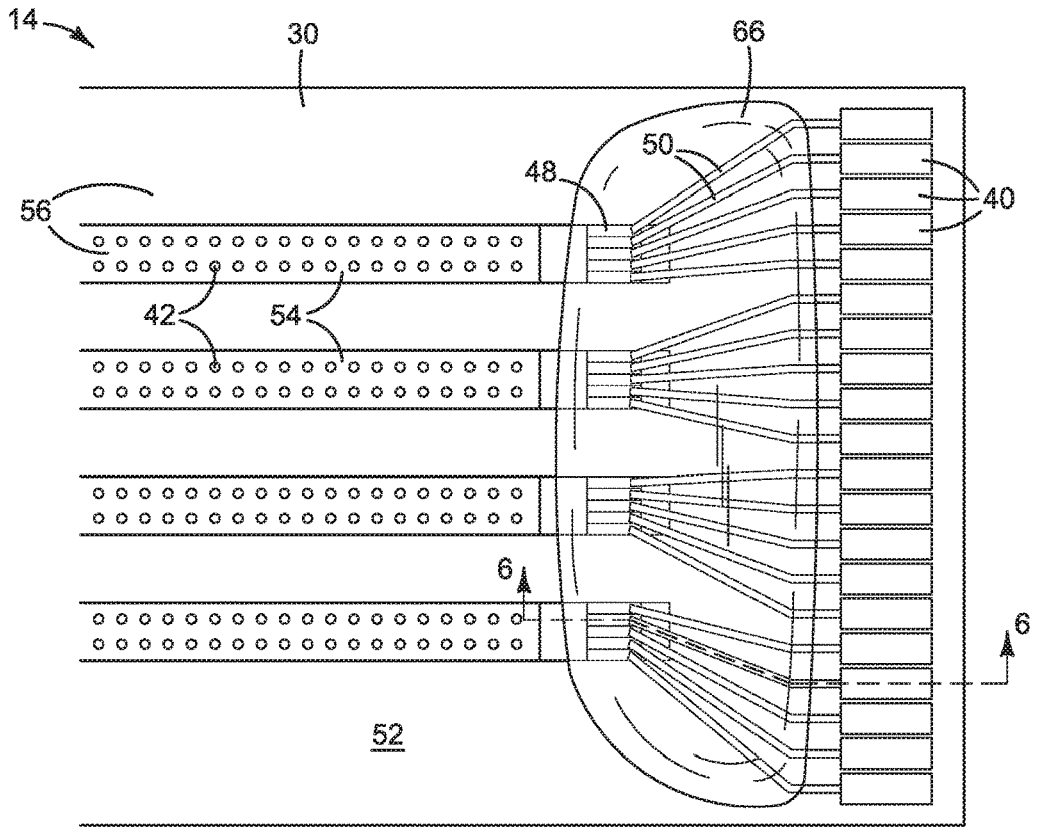
FIG. 5 is a plan view detail from FIG. 3 showing one example of an electrical connection between the printhead dies and external contacts.
Figure 6:
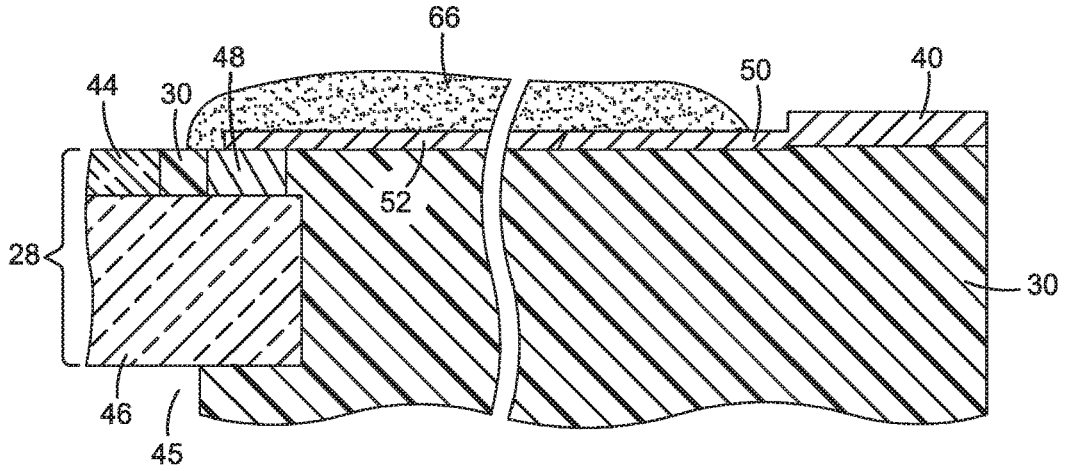
FIG. 6 is a section view taken along the line 6-6 in FIG. 5.

FIGS. 3 and 4 are perspective front and back views, respectively, of one example of a molded printhead 14 such as might be used in the ink cartridge 12 shown in FIGS. 1 and 2. FIG. 5 is a plan view detail from FIG. 3 and FIG. 6 is a section view taken along the line 6-6 in FIG. 5. Referring to FIGS. 3-6, printhead 14 includes multiple printhead dies 28 embedded in a monolithic molding 30 and channels 45 formed in molding 30 to carry printing fluid directly to the back part of corresponding printhead dies 28. In the example shown, each printhead die 28 is configured as an elongated die sliver such as that described in international patent application no. PCT/US2013/046065, noted above. Die slivers 28 are arranged parallel to one another across the width of printhead 14. Although four die slivers 28 are shown in a parallel configuration, more or fewer dies 28 may be used and/or in a different configuration.

An inkjet printhead die 28 is a typically complex integrated circuit (IC) structure 44 formed on a silicon substrate 46. Ink ejector elements and other components in each printhead IC circuit structure 44 are connected to signal traces in flex circuit 38, and thus to controller 26 (FIGS. 1 and 2), with bond pads or other suitable electrical terminals 48 on each die 28 directly or through substrate 46. Conductors 50 connect terminals 48 to contacts 40 for connection to external circuits. In the example shown in FIGS. 3-6, the front faces 52, 54 of molding 30 and dies 28 form a single uninterrupted planar printhead surface/face 56 surrounding ink ejection orifices 42, and conductors 50 and contacts 40 are formed along molding surface 52. One or both of conductors 50 and contacts 40 may be formed on or in molding surface 52, for example, by sputter deposition, plating, or with a lead frame. Conductors 50 may be covered by an epoxy or other suitable protective material 66 as necessary or desirable to protect the conductors from ink and other potentially damaging environmental conditions. Encapsulant 66 is omitted from FIGS. 2 and 3 and made transparent in FIG. 5 to more clearly show the underlying structures.

Figure 7:
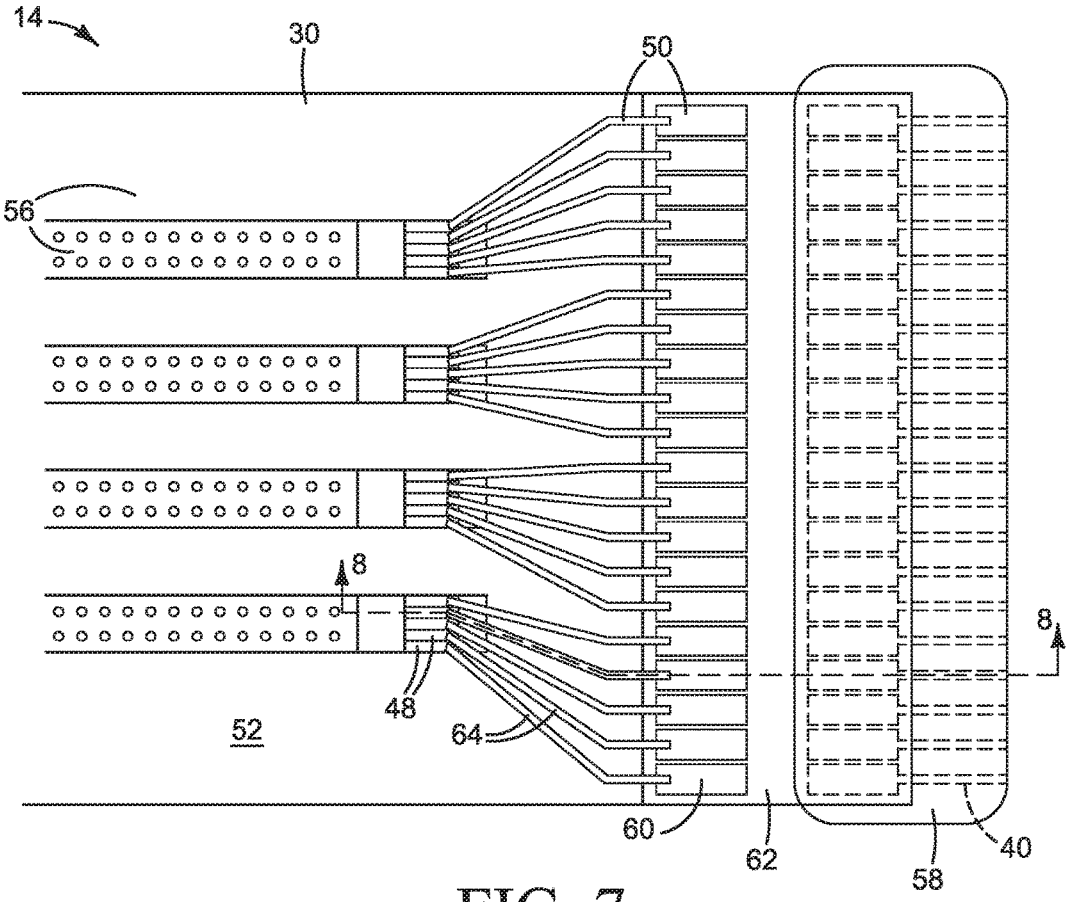
FIG. 7 is a plan view detail showing another example of an electrical connection between the printhead dies and external contacts.
Figure 8:
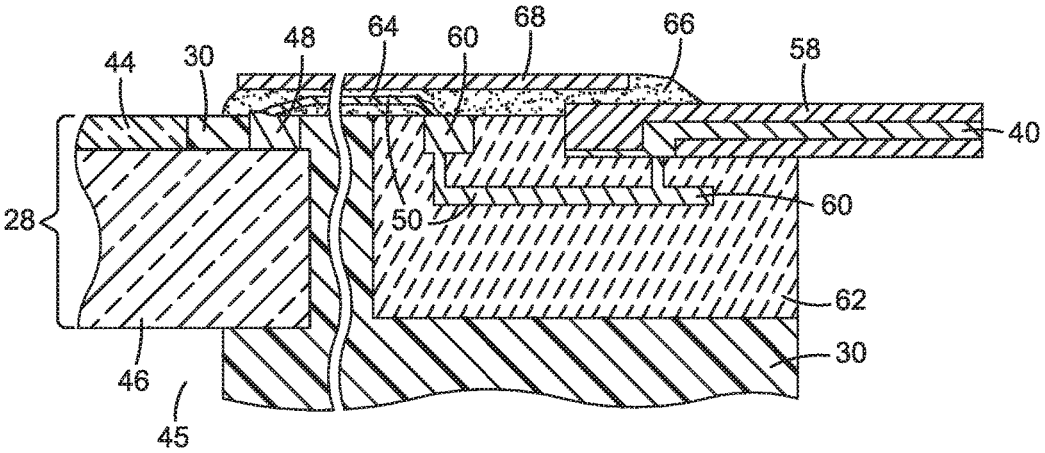
FIG. 8 is a section view taken along the line 8-8 in FIG. 7.

FIGS. 7 and 8 are plan and section view details showing another example of an electrical connection between printhead dies 28 and contacts 40 to connect to circuits external to printhead 14. Referring to FIGS. 7 and 8, in this example external contacts 40 are integrated into a TAB circuit 58 for connecting to flex circuit 38 (FIG. 2) and conductors 50 between contacts 40 and die terminals 48 are formed in two parts—(1) conductors 60 in a printed circuit board (PCB) 62 embedded in molding 30 and (2) bond wires 64 connecting PCB conductors 60 to die terminals 48. A printed circuit board (PCB) is also commonly referred to as a printed circuit assembly (PCA). Bond wires 64 are covered by an epoxy or other suitable protective material 66. A flat cap 68 may be added to form a more flat, lower profile protective covering on bond wires 64. Encapsulant 66 and cap 68 are omitted from FIG. 7 to more clearly show the underlying structures.

PCB 62 provides an inexpensive and adaptable platform for routing conductors 50 in printhead 14. For example, a PCB 62 facilitates the addition of ASICs (application specific integrated circuits) and SMDs (surface mounted devices) to printhead 14. For another example, it may desirable in some implementations to omit TAB circuit 58 and form contacts 40 in PCB 62. The combination of TAB circuit 58 and PCB 62 may be desirable, for example, to accommodate some configurations for die terminals 48 and externals contacts 40 and/or to allow more space for connecting to flex circuit 38 (FIG. 2). Also, while structures other than bond wires 64 may be used to connect the printhead dies to the PCB conductors, bond wire assembly tooling is readily available and easily adapted to the fabrication of printheads 14.

Figure 9:
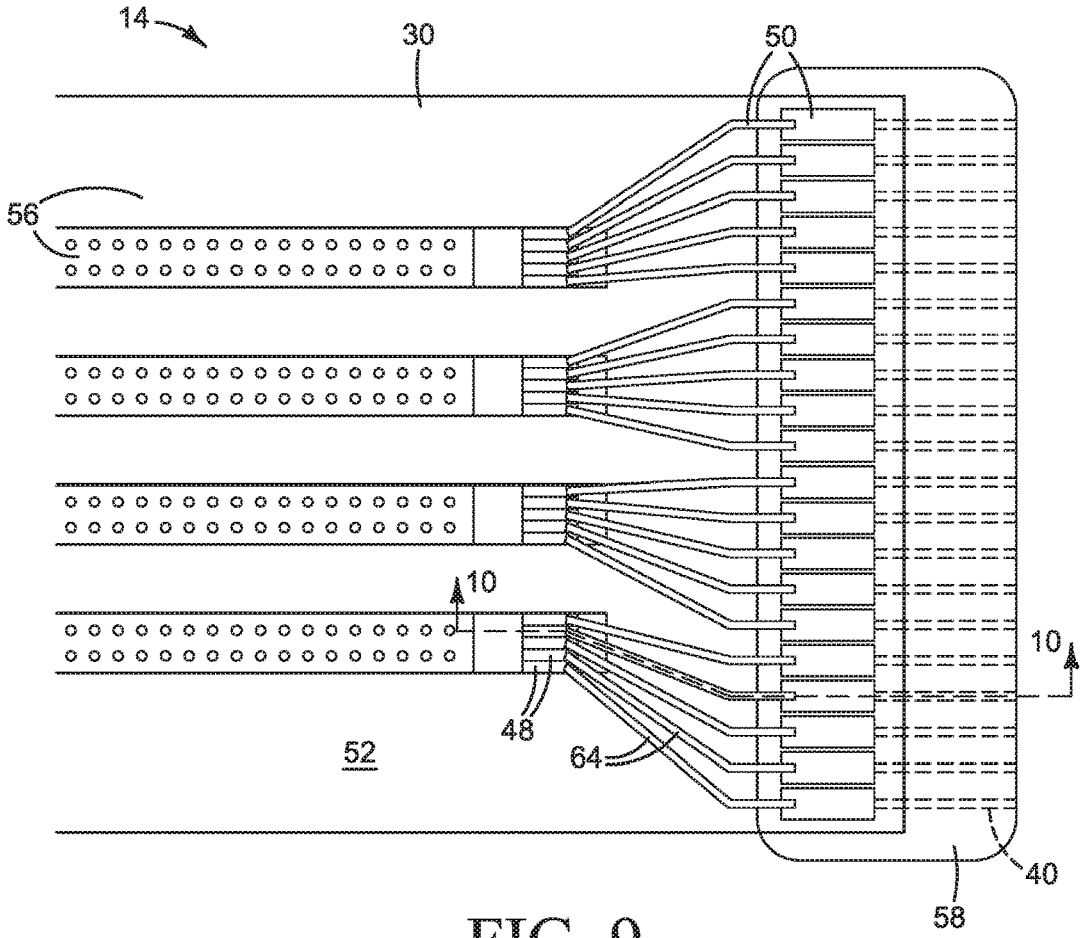
FIG. 9 is a plan view detail showing another example of an electrical connection between the printhead dies and external contacts.
Figure 10:
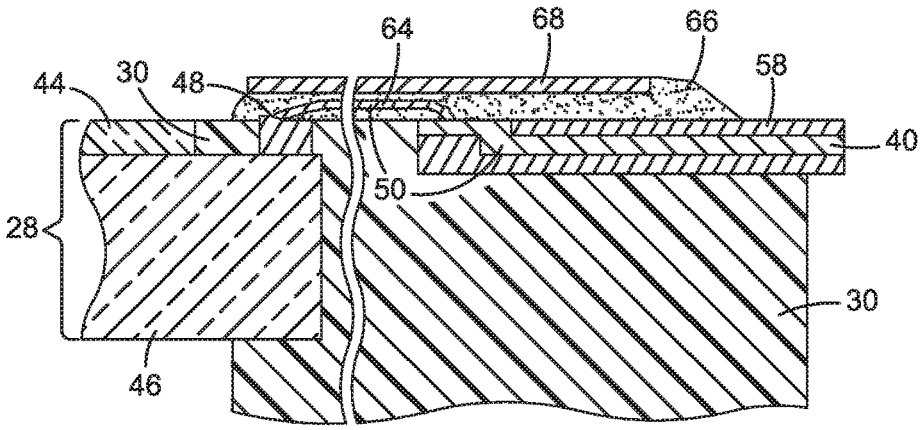
FIG. 10 is a section view taken along the line 10-10 in FIG. 9.

It may be possible in some implementations for molded printheads 14 to use a TAB circuit 58 that includes both contacts 40 and conductors 50, as shown in FIGS. 9 and 10. In this example, and referring to FIGS. 9 and 10, the bond wires 64 are connected between die terminals 48 and the conductors in TAB circuit 58. Again, encapsulant 66 and cap 68 are omitted from FIG. 9 to more clearly show the underlying structures.

Figure 11:
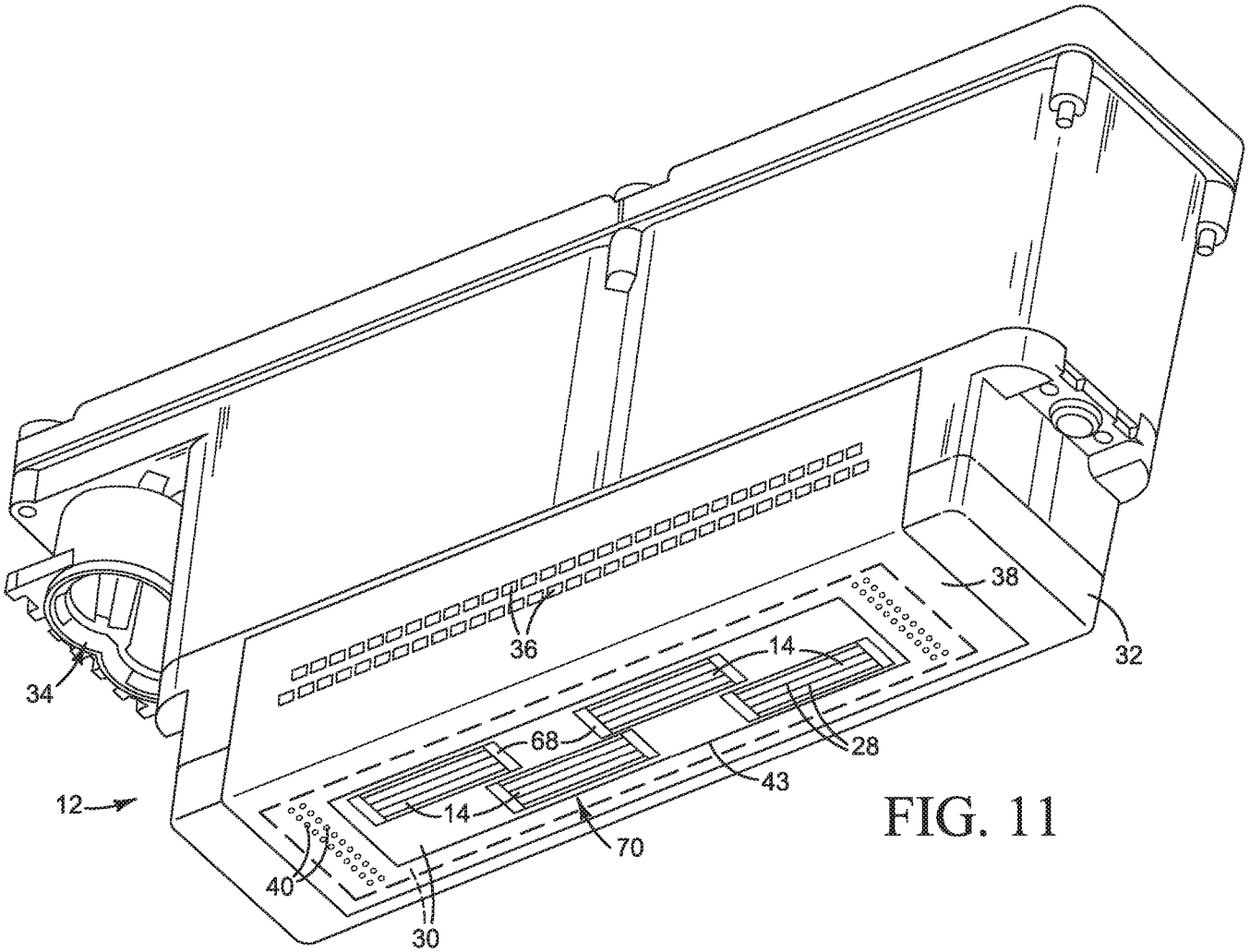
FIG. 11 is a perspective view illustrating another example of an ink cartridge such as might be used in the printer shown in FIG. 1.

FIG. 11 is a perspective view illustrating another example of an ink cartridge 12 such as might be used in the printer 10 shown in FIG. 1. Referring to FIG. 11, ink cartridge 12 includes a printhead assembly 70 with four printheads 14 each including four printhead dies 28 embedded in a molding 30 that is supported by cartridge housing 32. While a printhead assembly 70 with four printheads 14 is shown for this example of ink cartridge 12, other configurations are possible, for example with more or fewer printheads 14 each with more or fewer dies 28. Cartridge 12 is fluidically connected to an ink supply 22 (FIG. 1) through an ink port 34 and electrically connected to a controller 26 (FIG. 1) through electrical contacts 36. Contacts 36 are usually formed in a flex circuit 38 affixed to housing 32. Traces in flex circuit 38 connect contacts 36 to corresponding contacts 40 on printhead assembly 70. Ink ejection orifices on each printhead die 28 are exposed through an opening 43 in flex circuit 38 along the bottom of cartridge housing 32.

Figure 12:
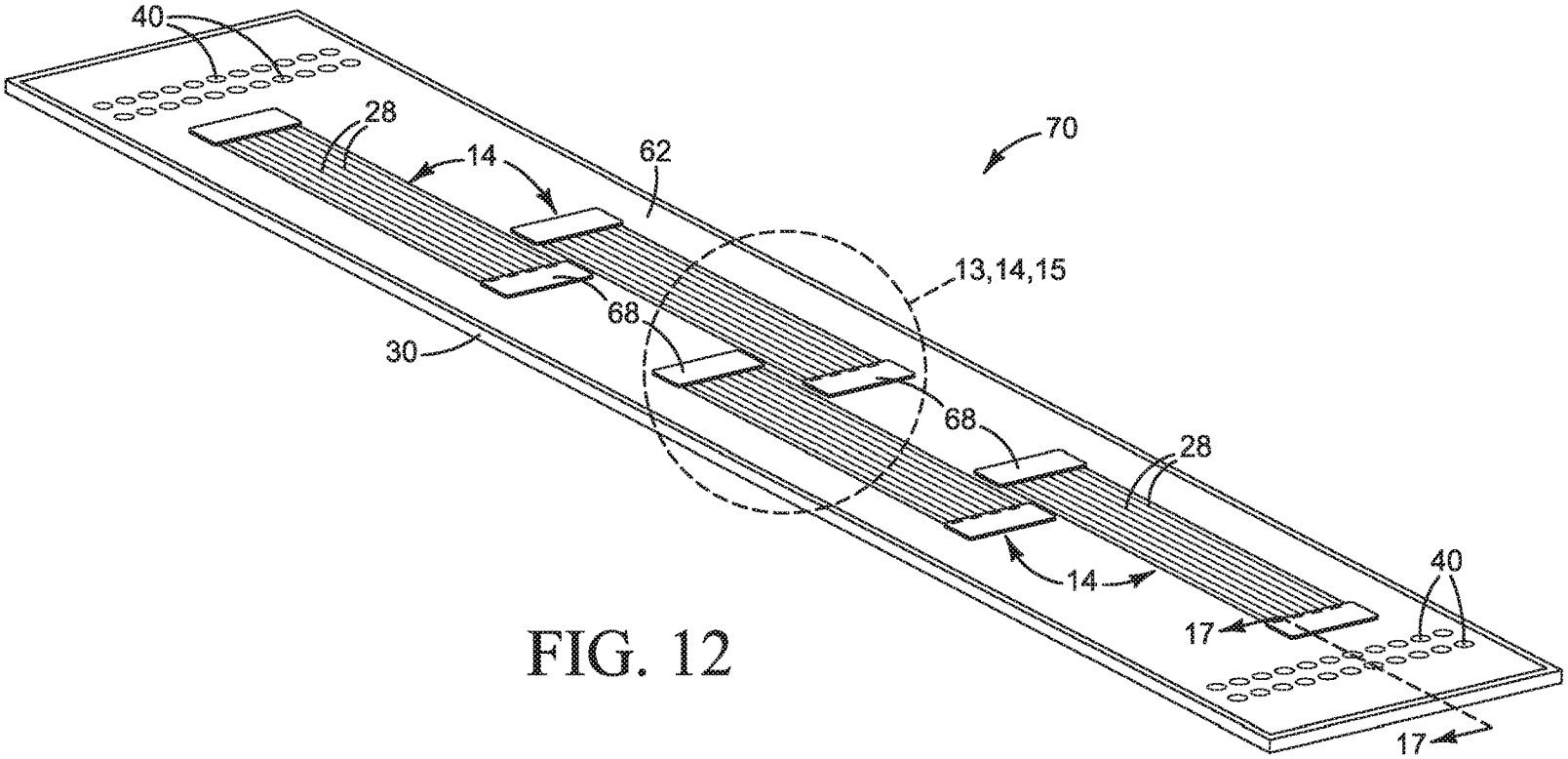
FIG. 12 is a perspective front view of a molded printhead assembly such as might be used in the ink cartridge shown in FIG. 11.
Figure 13:
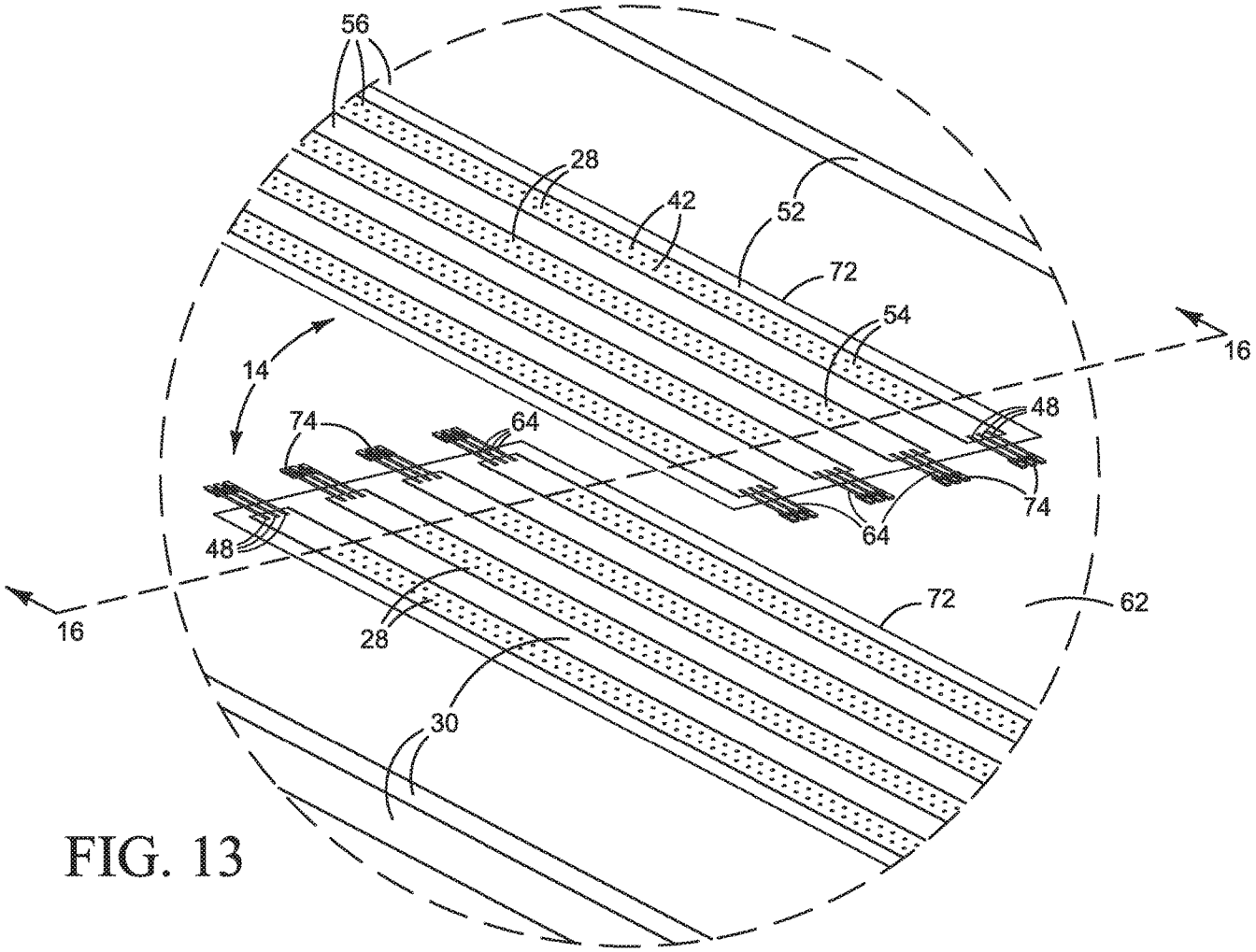
FIGS. 13-15 are close up views from FIG. 12 showing one example of an electrical connection between the printhead dies and external contacts.
Figure 14:
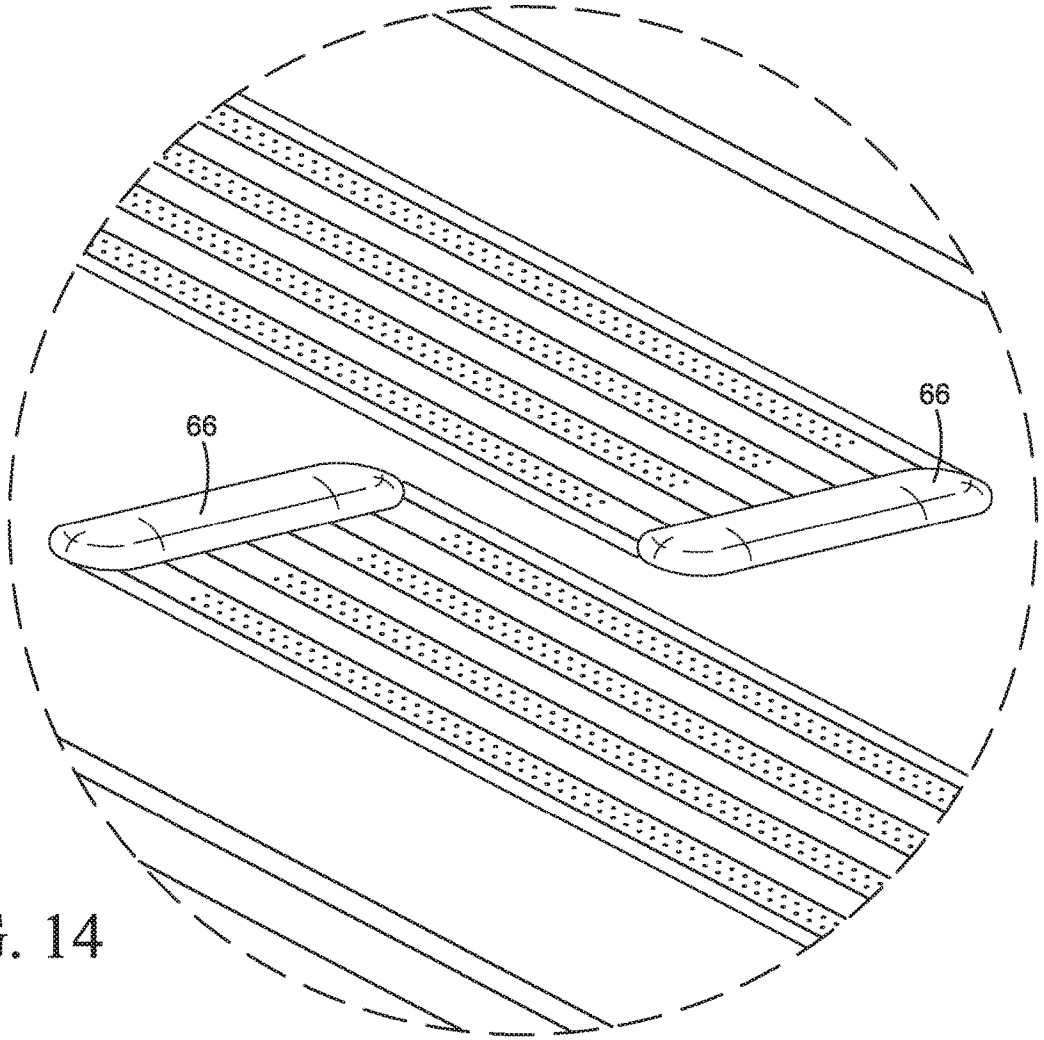
Figure 15:
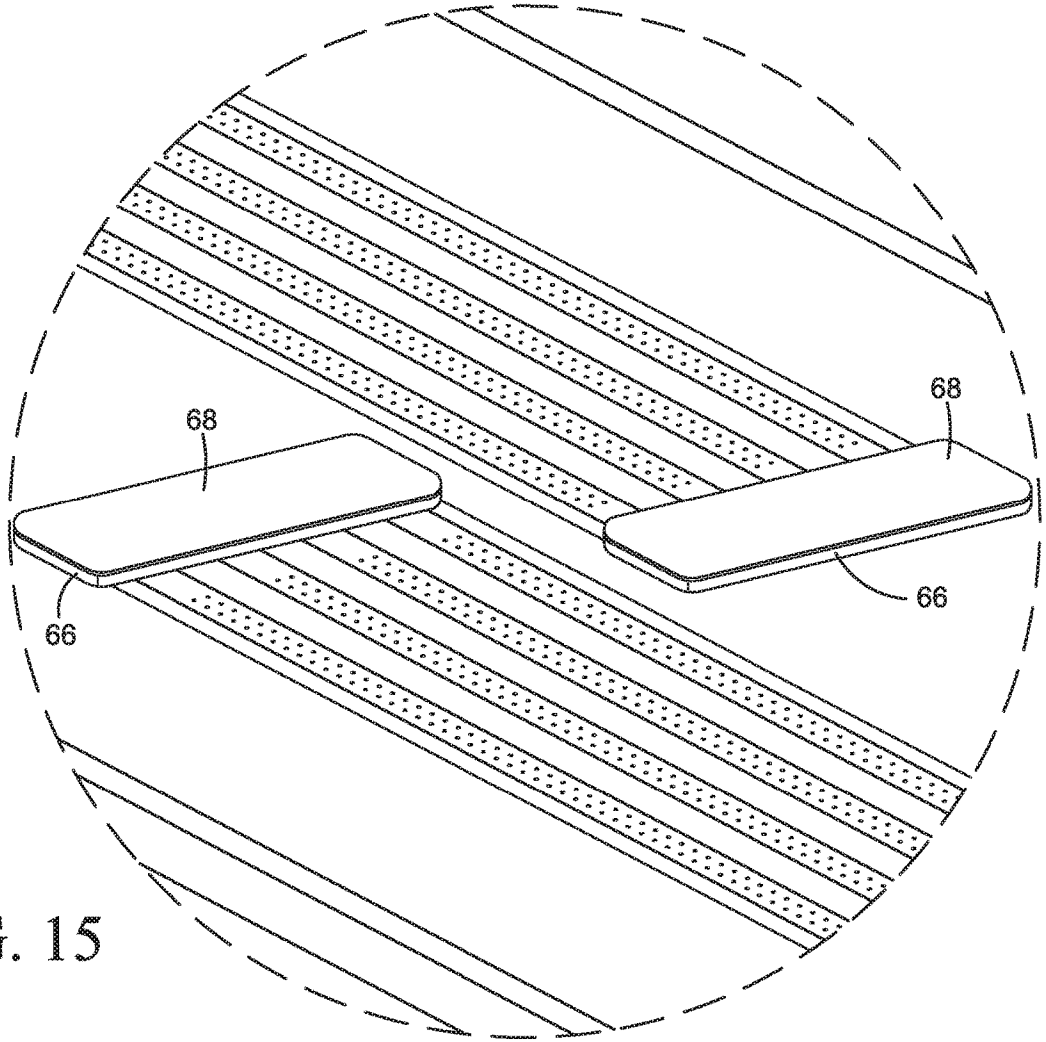
Figure 16:
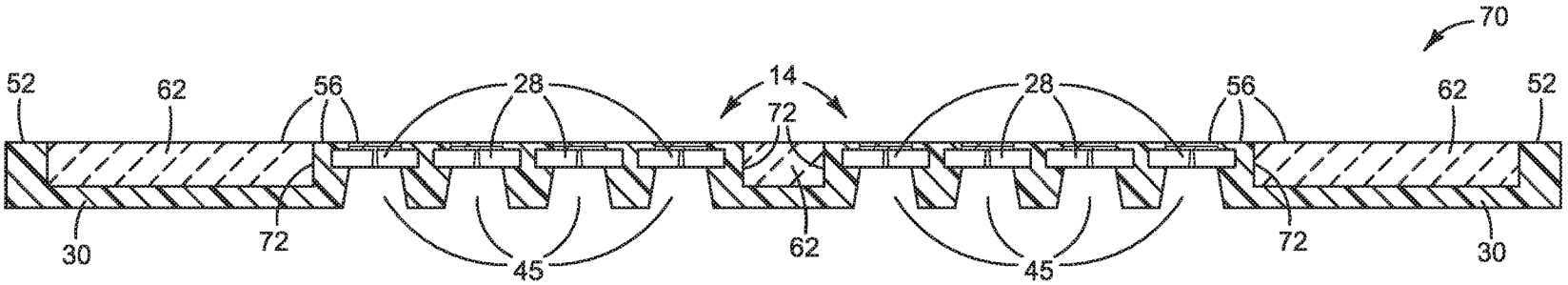
FIG. 16 is a section view taken along the lines 16-16 in FIG. 13.
Figure 17:
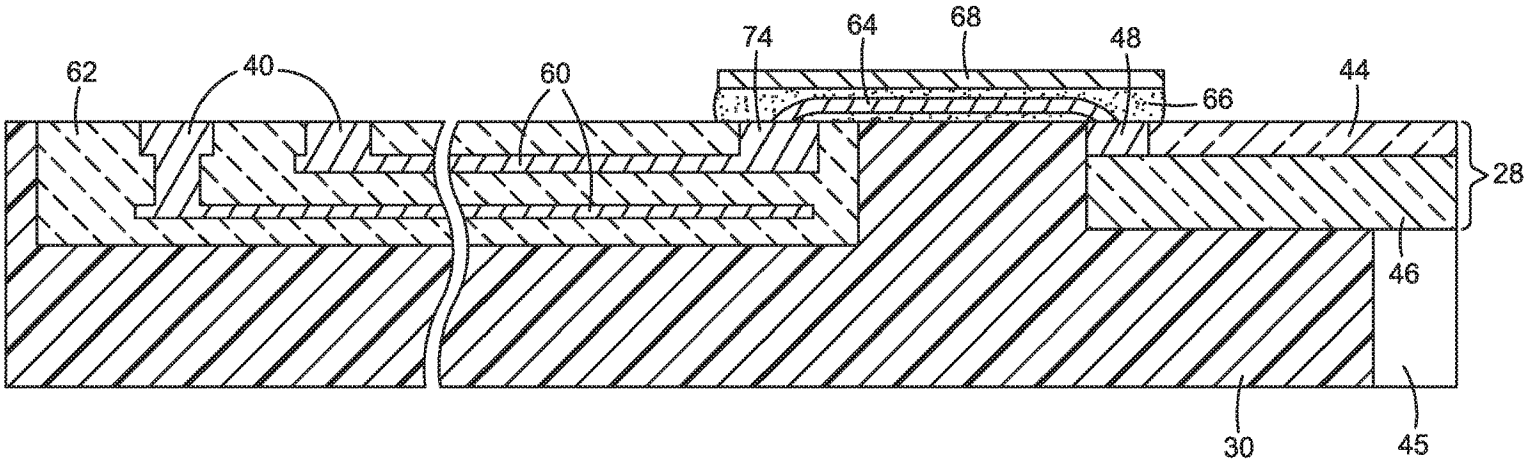
FIG. 17 is a section view taken along the line 17-17 in FIG. 12.

FIG. 12 is a perspective front view of a molded printhead assembly 70 such as might be used in the ink cartridge 12 shown in FIG. 11. FIGS. 13-15 are close up views from FIG. 12 showing one example of an electrical connection between printhead dies 28 and external contacts 40 in printhead assembly 70. In FIG. 13, the protective coverings on the wire bonds are omitted to show the underlying connections. In FIG. 14, the encapsulant covering the wire bonds is shown. In FIG. 15, the protective cap covering the encapsulant is shown. FIGS. 16 and 17 are section views taken along the lines 16-16 and 17-17 in FIGS. 13 and 12, respectively.

Referring to FIGS. 12-17, printhead assembly 70 includes multiple printheads 14 embedded in a monolithic molding 30 and arranged in a row lengthwise across the print bar in a staggered configuration in which each printhead overlaps an adjacent printhead. Although four printheads 14 are shown in a staggered configuration, more or fewer printheads 14 may be used and/or in a different configuration. Also, while it is expected that a monolithic molding 30 usually will be used, molding 30 could be formed in multiple parts. Each printhead 14 includes printhead dies 28 embedded in molding 30 and channels 45 formed in molding 30 to carry printing fluid directly to the back of corresponding printhead dies 28. Although four dies 28 arranged parallel to one another laterally across molding 30 in each printhead 14 are shown, more or fewer printhead dies 28 and/or in other configurations are possible.

As noted above, the development of the new, molded inkjet printheads has enabled the use of tiny printhead die "slivers" such as those described in international patent application no. PCT/US2013/046065. The molded printhead structures and electrical interconnections described herein are particularly well suited to the implementation of such tiny die slivers 28 in printheads 14. As shown in FIG. 17, the electrical conductors 60 that connect each printhead die 28 to external circuits are routed through a printed circuit board (PCB) 62 surrounding the group of dies 28 in each printhead 14. In the example shown, as best seen in FIGS. 13 and 16, dies 28 in each printhead 14 are positioned in an opening 72 in PCB 62 and molded so that the front face of molding 30, PCB 62, and dies 28 form a single uninterrupted planar surface along ink ejection orifices 42.

PCB conductors 60 carry electrical signals to ejector and/or other elements of each printhead die 28. As shown in FIGS. 13 and 17, PCB conductors 60 are connected to circuitry in each printhead die 28 through bond wires 64. Each bond wire 64 is connected between a bond pad or other suitable terminal 48 at the front part of a die 28 and a terminal 74 on PCB 62, Bond wires 64 are covered by an epoxy or other suitable protective material 66 (FIGS. 14 and 17). A flat cap 68 may be added to form a more flat, lower profile protective covering on bond wires 64. Although other conductor routing configurations are possible, a printed circuit board provides an inexpensive and adaptable platform for conductor routing in molded printheads. Similarly, as noted above, while other configurations may be used to connect the printhead dies to the PCB conductors, bond wire assembly tooling is readily available and easily adapted to the fabrication of printhead assembly 70 and printheads 14.

Figure 18:
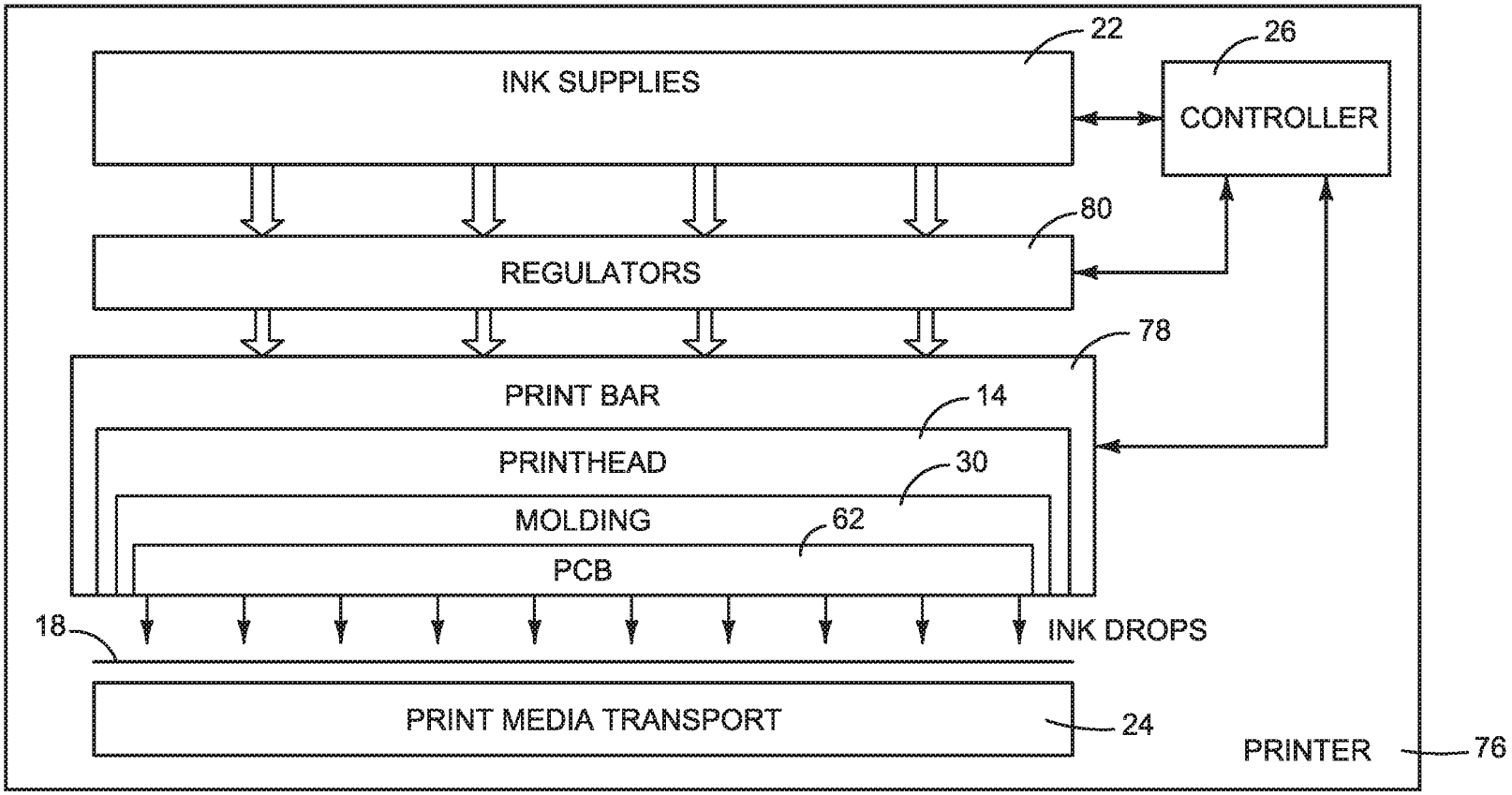
FIG. 18 is a block diagram illustrating an inkjet printer with a media wide print bar implementing another example of a new molded printhead.

FIG. 18 is a block diagram illustrating an inkjet printer 76 with a media wide print bar 78 implementing another example of a molded printhead 14. Referring to FIG. 18, printer 76 includes a print bar 78 spanning the width of a print media 18, flow regulators 80 associated with print bar 78, a media transport mechanism 24, ink or other printing fluid supplies 22, and a printer controller 26. Controller 26 represents the programming, processor(s) and associated memory(ies), and the electronic circuitry and components needed to control the operative elements of a printer 76. Print bar 78 in FIG. 18 includes one or more printheads 14 embedded in a molding 30 spanning print media 18, As described below with reference to FIGS. 19-24, the electrical connections between printhead(s) 14 and the contacts to external circuits are routed through a printed circuit board 62 embedded in molding 30.

Figure 19:
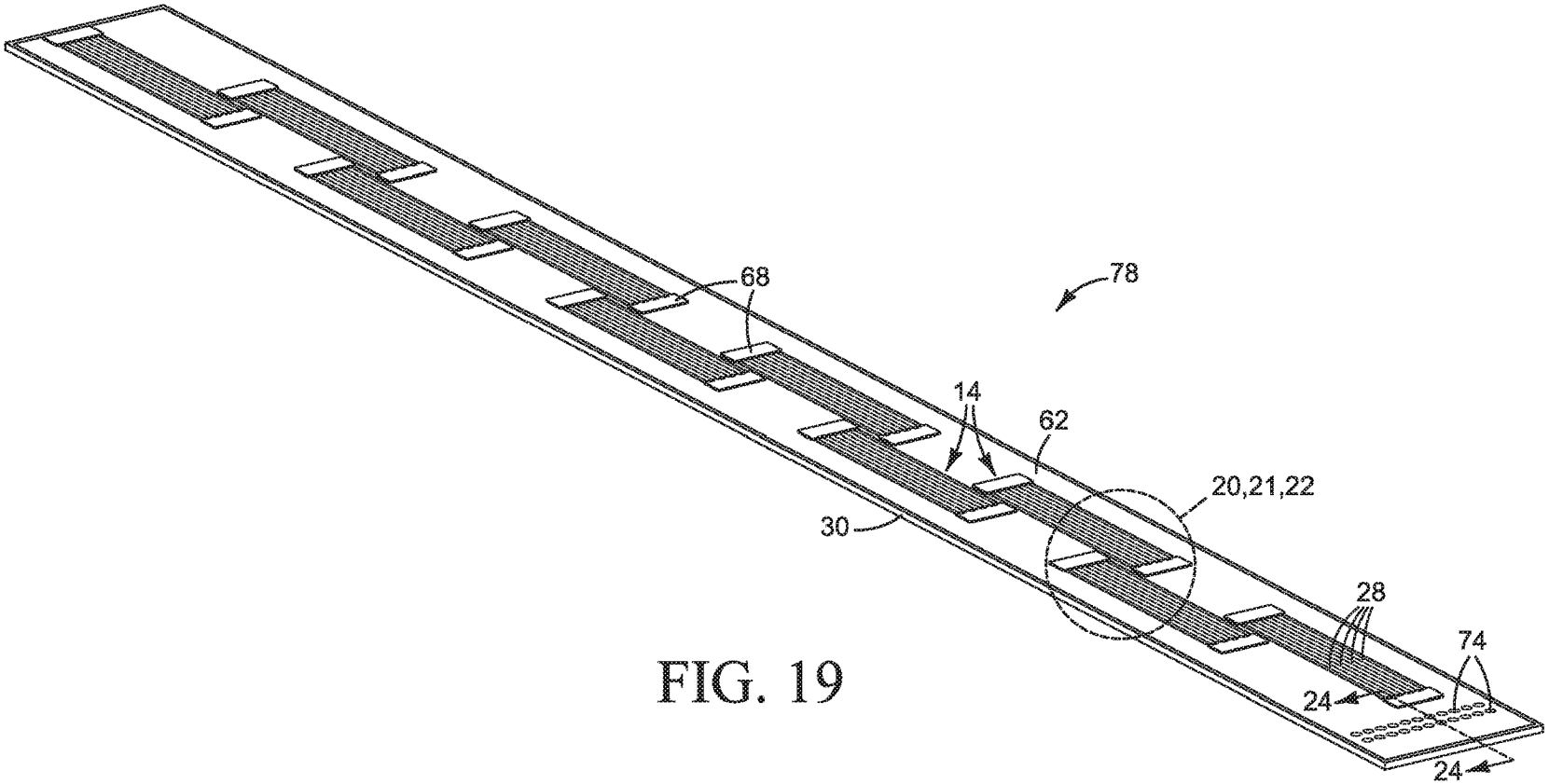
FIG. 19 is a perspective front view illustrating one example of a molded print bar with multiple printheads such as might be used in the printer shown in FIG. 18.
Figure 20:
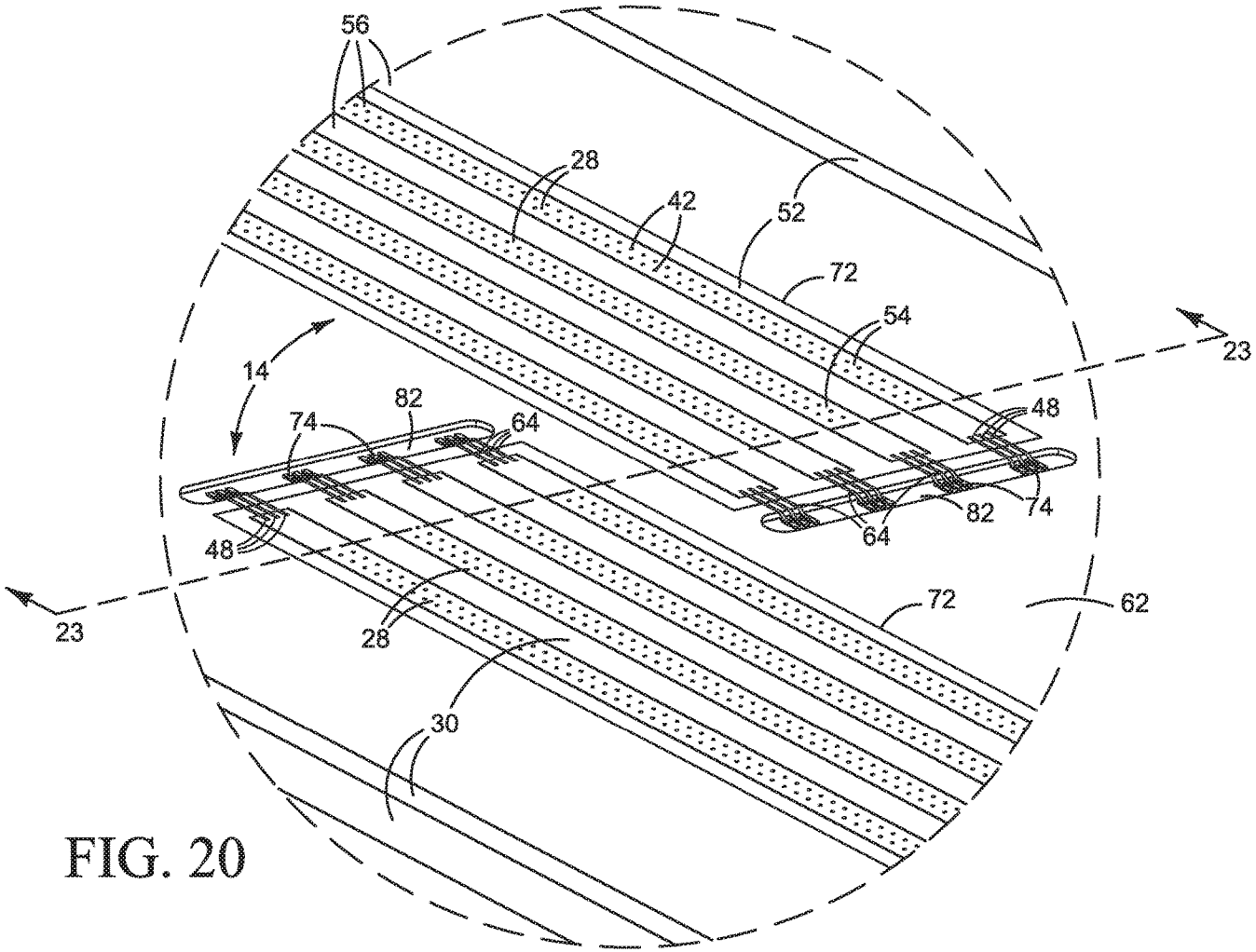
FIGS. 20-22 are close up views from FIG. 19 showing one example of an electrical connection between the printhead dies and external contacts.
Figure 21:
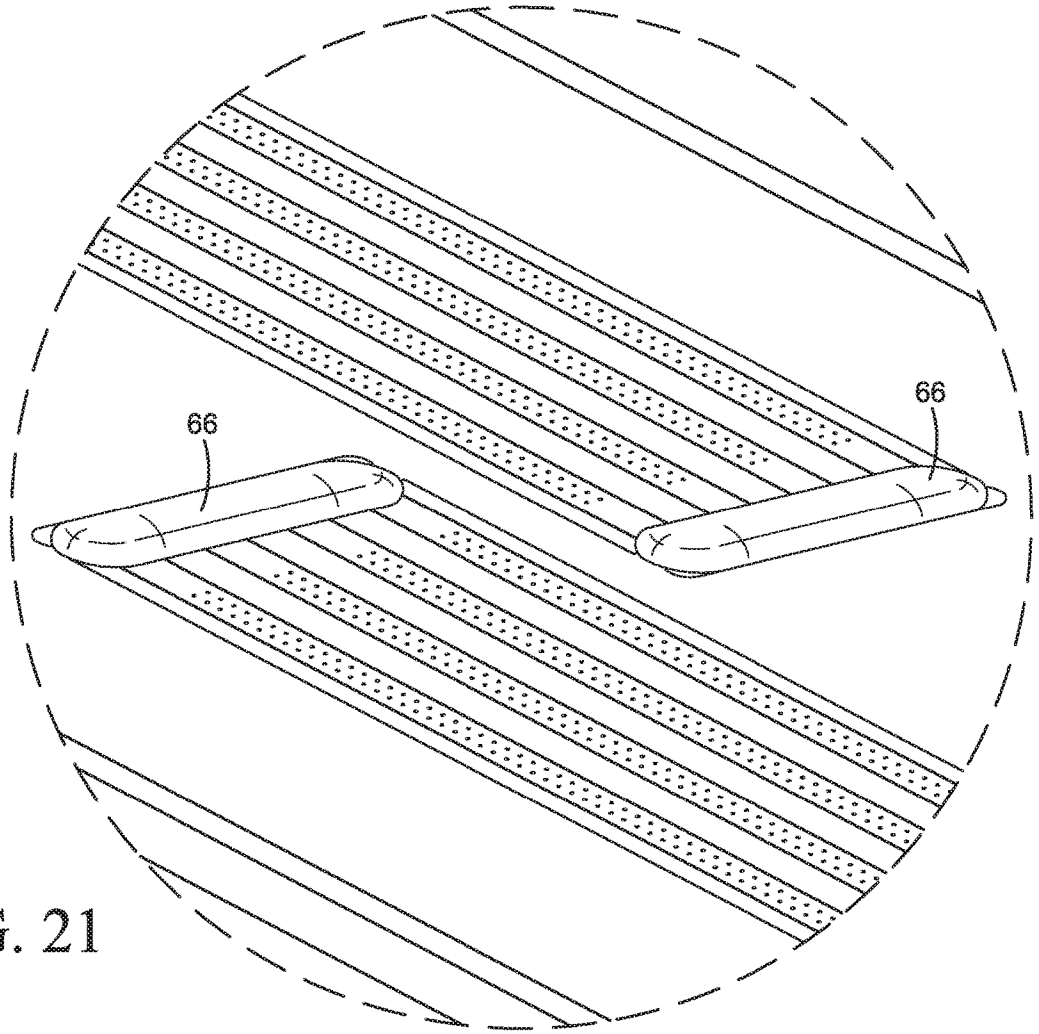
Figure 22:
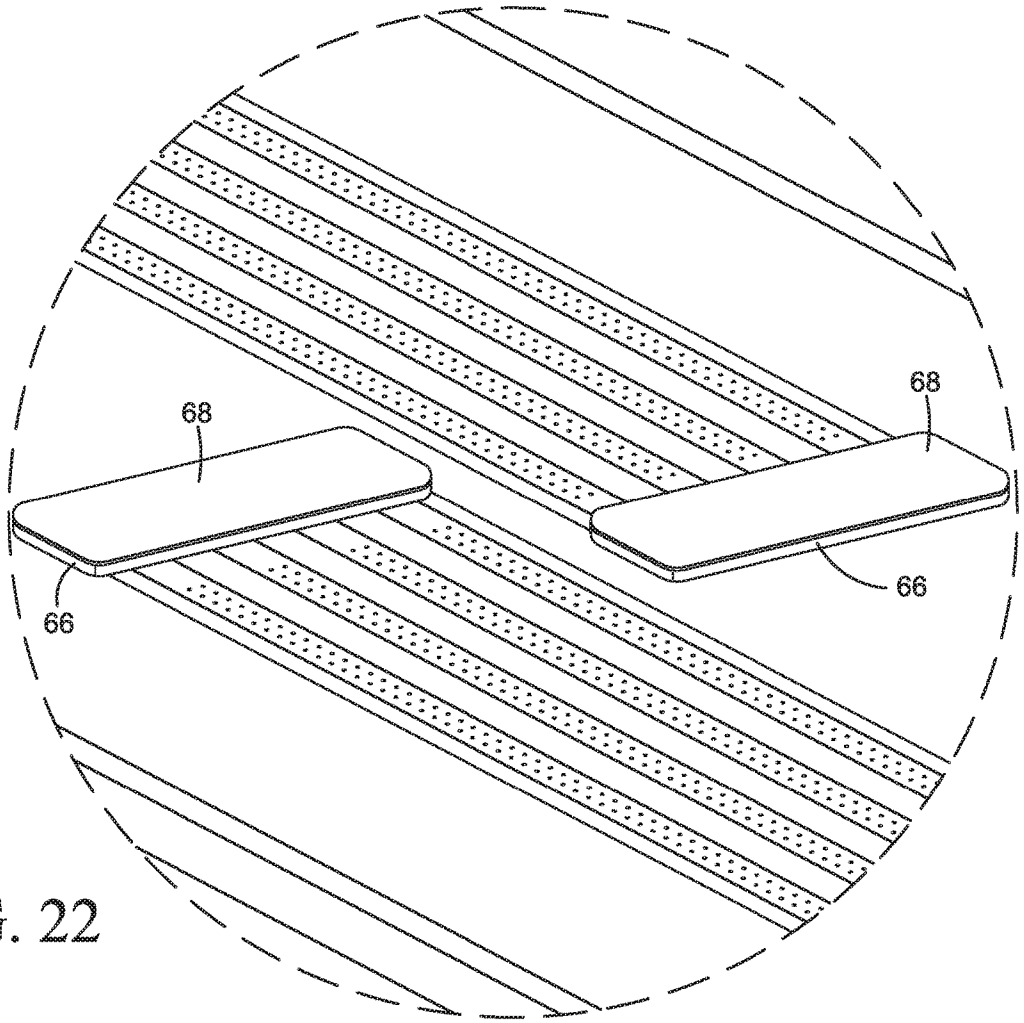
Figure 23:
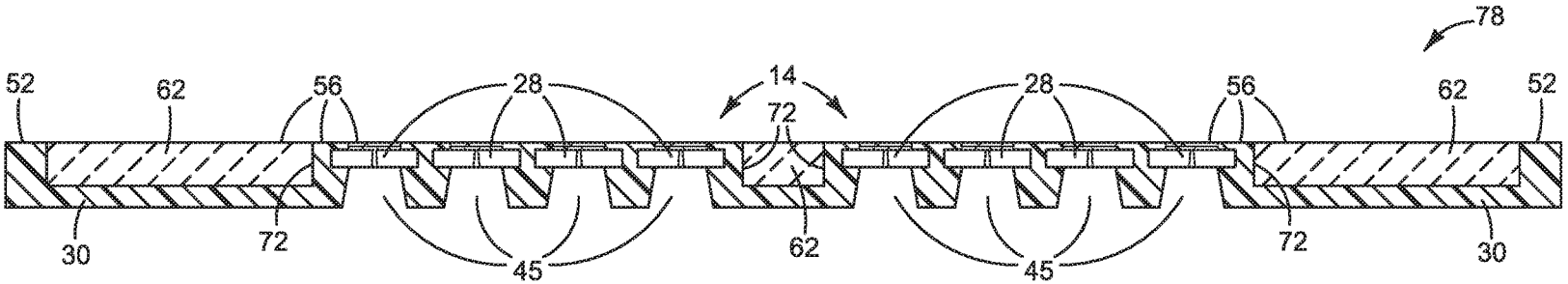
FIG. 23 is a section view taken along the line 23-23 in FIG. 20.
Figure 24:
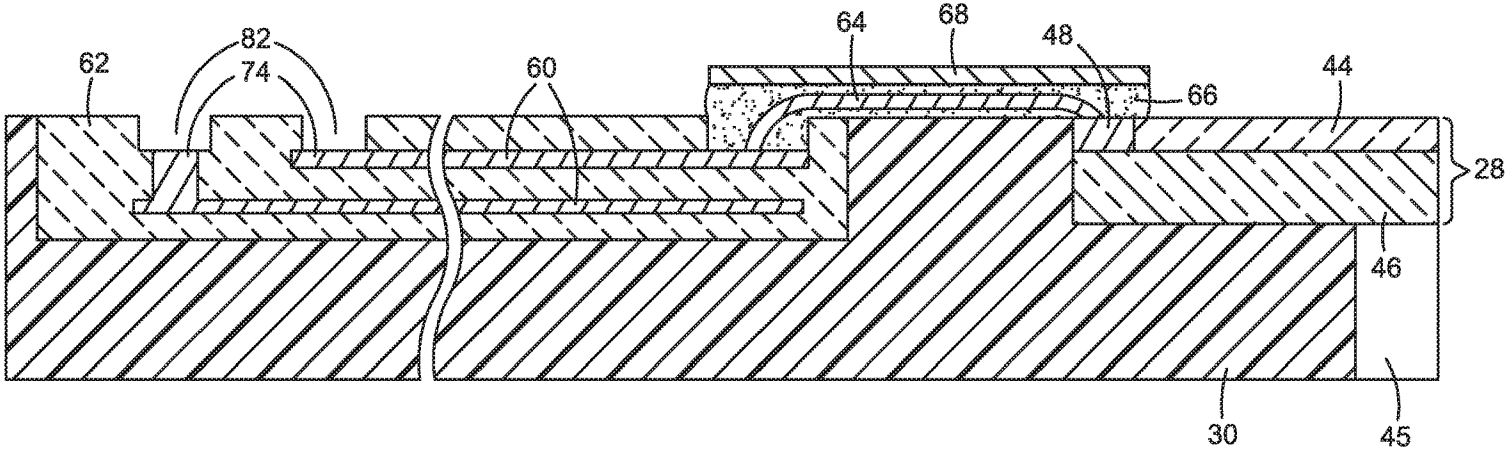
FIG. 24 is a section view taken along the line 24-24 in FIG. 19.

FIG. 19 is a perspective front view illustrating a molded print bar 78 with multiple printheads 14 such as might be used in the printer 76 shown in FIG. 18. FIGS. 20-22 are close up views from FIG. 19 showing one example of an electrical connection between printhead dies 28 and external contacts 40. In FIG. 20, the protective coverings on the wire bonds are omitted to show the underlying connections. In FIG. 21, the encapsulant covering the wire bonds is shown. In FIG. 22, the protective cap covering the encapsulant is shown. FIGS. 23 and 24 are section views taken along the lines 23-23 and 24-24 in FIGS. 20 and 19, respectively.

Referring to FIGS. 19-24, print bar 78 includes multiple printheads 14 embedded in a molding 30 and arranged in a row lengthwise across the print bar in a staggered configuration in which each printhead overlaps an adjacent printhead. Although ten printheads 14 are shown in a staggered configuration, more or fewer printheads 14 may be used and/or in a different configuration. Examples are not limited to a media wide print bar. Examples could also be implemented in a scanning type inkjet cartridge or printhead assembly with fewer molded printheads, or even a single molded printhead similar to the one shown in FIG. 3. Each printhead 14 includes printhead dies 28 embedded in molding 30 and channels 45 formed in molding 30 to carry printing fluid directly to the back of corresponding printhead dies 28. Although four dies 28 arranged parallel to one another laterally across molding 30 in each printhead 14 are shown, for printing four different ink colors for example, more or fewer printhead dies 28 and/or in other configurations are possible. As noted above, the molded printhead structures and electrical interconnections described herein are particularly well suited to the implementation of such tiny die slivers 28 in printheads 14.

As shown in FIG. 24, the electrical conductors 60 that connect each printhead die 28 to external circuits are routed through a printed circuit board (PCB) 62 surrounding the group of dies 28 in each printhead 14. As best seen in FIGS. 20 and 23, dies 28 in each printhead 14 are positioned in an opening 78 in PCB 62 and molded so that the front face of molding 30, PCB 62, and dies 28 form a single uninterrupted planar surface along ink ejection orifices 42. PCB conductors 60 carry electrical signals to ejector and/or other elements of each printhead die 28. As shown in FIGS. 20 and 24, PCB conductors 60 are connected to circuitry in each printhead die 28 through bond wires 64. Each bond wire 64 is connected between a bond pad or other suitable terminal 48 at the front part of a die 28 and a terminal 80 on PCB 62. PCB terminals 80 may be exposed in a recess 82 in the PCB, as shown, to help make a more flat, lower profile face to facilitate servicing dies 28. Bond wires 64 are covered by an epoxy or other suitable protective material 66. A flat cap 68 may be added to form a more flat, lower profile protective covering on bond wires 64.

"A" and "an" as used in the Claims means one or more. As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. An ink cartridge comprising:

a cartridge housing having an ink chamber including an ink supply integrated in the ink chamber;

a molding; and at least one die sliver embedded in the molding, the at least one die sliver having a back part to which ink of the ink supply passes;

wherein a surface of the at least one die sliver is coplanar with a surface of the molding.

2. The cartridge of claim 1, wherein the at least one die sliver comprises a liquid ejection die.

3. The cartridge of claim 1, further comprising a fluid channel fluidly connecting the ink supply with the back part of the at least one die sliver, the fluid channel being formed in the molding in which the at least one die sliver is embedded for delivering liquid to the at least one die sliver.

4. The cartridge of claim 1, wherein further comprising conductors running between a plurality of die slivers and electrical contacts, the conductors being disposed along a surface of the molding.

5. The cartridge of claim 1, wherein:

the at least one die sliver comprises a plurality of liquid ejection die slivers; and the molding comprises a molded panel of molded material in which the plurality of ejection die slivers is embedded, wherein the liquid ejection die slivers are arranged end to end along a length of the panel, with ejection orifices of each liquid ejection die being exposed at a first surface of the panel.

6. The cartridge of claim 5, wherein a face of the molded panel and a face of each of the liquid ejection die slivers forms a single, uninterrupted planar surface surrounding ink ejection orifices of the liquid ejection die slivers.

7. The cartridge of claim 5, further comprising conductors between the liquid ejection die slivers and electrical contacts, the conductors being disposed along the face of the molded panel.

8. The cartridge of claim 1, wherein the at least one die sliver has a ratio of length to width of at least 50.

9. The cartridge of claim 1, further comprising a printed circuit board embedded in the molding with an electrical connection between the at least one die sliver and a contact external to the molding.

10. The cartridge of claim 9, wherein the electrical connection comprises a bond wire between the printed circuit board and a terminal on the at least one die sliver.

11. The cartridge of claim 10, wherein the bond wire is covered by an encapsulant which is covered by a flat cap.

12. The cartridge of claim 1, wherein the at least one die sliver comprises a plurality of liquid ejection die slivers arranged in a plurality of rows running side-by-side along a length of the molding.

13. The cartridge of claim 12, wherein the liquid ejection die slivers are arranged in a staggered configuration in which ends of adjacent die slivers overlap along a width of the molding.

14. A fluid ejection cartridge comprising:

a cartridge housing having a chamber including an fluid supply;

a plurality of die slivers; and a molding formed of molded material;

wherein the plurality of die slivers are embedded in the molding, a fluid-receiving interface of each die sliver being exposed to receive fluid from the fluid supply via a channel formed, at least partially, in the molded material of the molding.

15. The cartridge of claim 14, wherein the die slivers are arranged end to end along a length of the molding, with ejection orifices of each die sliver being exposed at a first surface of the molding.

16. The cartridge of claim 14, further comprising an electrical connection, comprising a bond wire, between a printed circuit board and a terminal on at least one of the die slivers.

17. The cartridge of claim 14, wherein a surface of each of the die slivers is coplanar with a surface of the molded material of the molding.

18. The cartridge of claim 14, wherein:

the plurality of printhead die slivers are further arranged in a plurality of rows running side-by-side along a length of the molding; and the die slivers are arranged in a staggered configuration in which ends of adjacent die slivers overlap along a width of the molding.

19. A fluid ejection cartridge comprising:

a cartridge housing having a chamber including an fluid supply;

a plurality of die slivers; and a molding formed of molded material; and an electrical connection, comprising a bond wire, between a printed circuit board and a terminal on at least one of the die slivers;

wherein the plurality of die slivers are embedded in the molding, a fluid-receiving interface of each die sliver being exposed to receive fluid from the fluid supply via a channel formed, at least partially, in the molded material of the molding; and wherein the bond wire is covered by an encapsulant which is covered by a flat cap.

* * * * *